United States Patent [19]

Bramhall

[11] Patent Number: 4,815,822

[45] Date of Patent: Mar. 28, 1989

[54] SHOOTER'S SUNSHADE

[76] Inventor: Wesley G. Bramhall, 8305 E. Pima, Tucson, Ariz. 85715

[21] Appl. No.: 669,449

[22] Filed: Nov. 8, 1984

[51] Int. Cl.[4] ..... G02B 1/00

[52] U.S. Cl. ..... 350/276 R; 33/244; 42/100; 350/578

[58] Field of Search ..... 350/276 R, 578; 42/1 ST, 1 S; 33/244

[56] References Cited

U.S. PATENT DOCUMENTS

| | | | |
|---|---|---|---|
| 1,283,963 | 11/1918 | Takahashi | 33/244 |
| 2,899,629 | 6/1959 | Darkenwald . | |
| 3,315,362 | 4/1967 | Palmer . | |
| 3,390,931 | 7/1968 | Luning . | |
| 4,089,117 | 7/1978 | Villarreal | 42/1 ST |

FOREIGN PATENT DOCUMENTS

| | | | |
|---|---|---|---|
| 1463525 | 11/1966 | France | 350/578 |

*Primary Examiner*—John K. Corbin

*Assistant Examiner*—Rebecca D. Gass

[57] ABSTRACT

A sunshade for attachment to the end of a rifle scope or receiver for blocking the sun's direct rays or light from other sources from entering a shooter's eye when the shooter is aiming at a target in the general direction of the sun or source of light. The sunshade is adapted to surround the rear eyepiece of the rifle scope or be placed proximate the rear sight of a rifle and employs a shield to protect against direct light from the luminous source entering into the shooter's eyes. The shield, taking generally the shape of a semi-circle, is made from most any material, hard or flexible, and is supported in place by means of internal reinforcements which attach to a clamp or other structural mechanism adapted to reside around the scope rear eyepiece or attached to the rifle receiver. For bolt action rifles, the shield is made of flexible meterial in order that the bolt of the rifle may be drawn past the shield by the shield flexing out of the way.

16 Claims, 2 Drawing Sheets

SHOOTER'S SUNSHADE

BACKGROUND OF THE INVENTION

If any person or hunter has ever has to aim a rifle at a target in the general direction of the sun or a source of light, the shooter has experienced the problem of sunlight or other light from a source flooding his eye to the point that it becomes difficult, if not impossible, to define the target. With so much light flooding into the eye, the eye can not distinguish the target as all that the shooter sees is the bright light. As the shooter aims the rifle farther and farther away from the source of the light, the target then becomes more and more visible.

It may be possible for the shooter to shade his eyes from the source of light by holding a hand up to block off the offending light rays; however, if the shooter is attempting to aim the gun, both hands are necessary, and thus leaving no hand free to block the sun's rays.

It is obvious that should a shooter aim directly at the sun or the source of the light, or if the target and the sun are within the rifle's telescopic sight field, no means of protection can shield the shooter's eyes from the rays of light.

Now there have been devices to overcome this problem on rifles utilizing scopes. For example, Palmer in U.S. Pat. No. 3,315,362, details an attachment for a telescopic sight comprising a flexible cylinder eyepiece which attaches to the sighting end of the scope and terminates in a cushioned element adapted to engage the shooter's face surrounding the eye. Similarly, Luning, in U.S. Pat. No. 3,390,931, details a similar apparatus with the exception that it confines light emitting from a phosphor screen from illuminating the shooter's face at night times.

Such devices accomplish the purpose of preventing light from entering the shooter's eye except for the light which comes through the telescopic sight, however, such devices suffer from the shortcomings of having the shooter's eye fully engaged by the eyepiece, and severely limit the shooter's vision around the area that the rifle may be aimed at. This can be very important if the shooter is a hunter. In addition, for situations where a hunter must aim the gun and shoot the target all within a very short space of time, such as usually is the case, the aforementioned inventions become quite cumbersome in that instead of just looking through the scope, the hunter must engage the eyepiece with his face while all the time trying to following the moving target. This obviously, becomes very difficult.

In addition, the invention of the above patents obviously do not apply to rifles with open sights as both patents define eyepieces attached to the sighting end of the rifle's scope.

Thus, it is readily apparent that there is need for a means or shield which will block sunlight or other light which would otherwise enter a shooter's eye as he aims his rifle, with or without a telescopic sight, at a target which is in the same general direction as the sun or source of light. In addition, such a means should not interfere with the aiming process, not be of such a type that the shooter would require additional effort or time to aim at the target due to requirements which may be imposed by the device itself.

BRIEF SUMMARY OF THE INVENTION

The present invention defines a device adapted to block sunlight or light from a luminous source from entering a shooter's eye as the shooter is aiming his rifle at a target in the general vicinity of the sun or other source of light. To this end, the Applicant has devised a shooter's sunshade adapted to reside on a rifle scope near the sighting end which blocks sun rays or other light from entering the shooter's eyes when sighting through the scope. This device comprises generally a semi-circular shield positioned at right angles to the longitudinal axis of the telescopic sight, and which surrounds the end of the telescopic sight much like a fan. The device is mounted to the telescopic sight by means of a circular clamp, the clamp adapted to reside over the circular sighting end of the scope and be held there by compressing around the scope. The semi-circular shield is attached to the clamp by means of internal or external (to the shield) reinforcement which fastens to the clamp. The clamp may take the form of an almost completed circle with a spring attaching the ends to apply the necessary pressure to the round scope to hold the clamp and thus the shield in place, or the clamp may take the form of a completed circular spring which, through its own action, holds tight to the cylindrical surface of the scope.

In addition, the shooter's sunshade may be attached to a rifle with open sights by attachment to the rifle receiver immediately forward or in close proximity to the open sight. The semi-circle shape of the shield is modified at its center by a half moon in order to open up the line of sight between the rear sight and the front bead of the rifle.

The shield is constructed from practically any material and may be completely opaque or may have varying degrees of opacity, being translucent to the point of being almost transparent, much as is seen in sunglasses. In addition, if the sunshade is to be used with a bolt action rifle, the shield may be made of flexible material such as rubber which will flex and bend out of the way to allow the bolt to be drawn to the rear. In the sunshade, internal reinforcements spread fingers throughout the structure of the shield to assure that it retains its shape. The fingers eventually are attached to the circular clamp.

It is an object of the subject invention to provide means to block light from entering a shooter's eyes while the shooter is aiming the rifle in the general direction of the sun or other source of light.

It is another object of the subject invention to provide a sunshade which, while blocking light from the shooter's eyes, additionally allows the shooter to operate the rifle without interference from the sunshade.

It is still further an object of the subject invention to provide a sunshade for a rifle with open sights which does not interfere with the sighting of the rifle.

BRIEF DESCRIPTION OF THE DRAWINGS

For further understanding of the nature and objects of the present invention, reference should be had to the following detailed description taken in connection with the accompanying drawings wherein:

FIG. 8 is a perspective view of a camera utilizing the invention.

In the various views, like index numbers refer to like elements.

DETAILED DESCRIPTION OF THE PREFERRED EMBODIMENT

Figure 1:
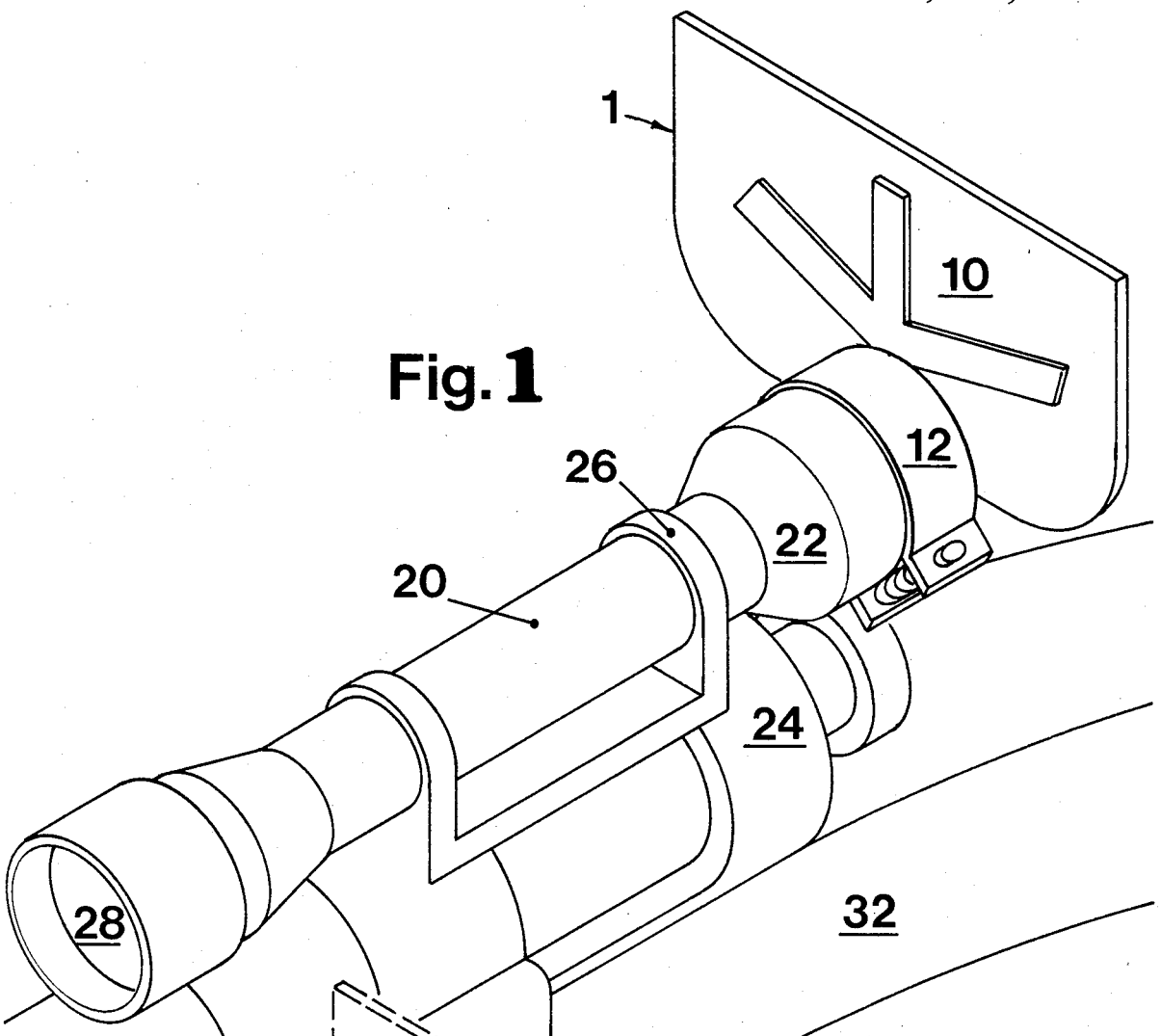
FIG. 1 is a fragmentary perspective view of a rifle with the invention mounted upon the sighting end of the scope.

Referring now to FIG. 1, a fragmentary perspective view of a rifle having the inventive shooter's sunshade 1 mounted upon the sighting end of the rifle's telescopic sight is detailed. As may be seen, sunshade 1 has a clamp 12 which encircles the end eyepiece 22 of the telescopic sight or "scope" 20 as it is commonly known. Sunshade 1 is adapted to prevent direct light from the sun or other source of light from entering the shooter's eye when the shooter is attempting to aim the rifle at a target which is in the general direction of the sun or other source of light. It is realized of course, that the shooter may not view the sun directly through the scope or within the scope's field of view, as sunshade 1 then will offer absolutely no protection whatsoever. However, this situation very rarely presents itself. Most often, the target may be in the general vicinity of the direction of the source of light and unless direct light is prevented from coming ito the shooter's eye from the source of light, the shooter will not be able to distinguish the target. The sunshade 1 does not keep out reflected light that would enter the shooter's eye from the sides as there is no need to do so. The primary consideration is to block light coming direct from the source of the light which would tend to interfere with the shooter's aiming at the object by flooding the eye with so much light that the target may not be distinguished.

The means by which the thin, flat shield 10 in its preferred embodiment, is held at right angles to the longitudinal axis of scope 20, and thus the rifle barrel, is clamp 12 wherein metal finger supports or reinforcements are attached to clamp 12 and which are embedded interiorly to shield 10. In the preferred embodiment, shield 10 may be constructed of an opaque or translucent material, and may either be a hard, stiff material or one that is flexible. It is envisioned that if the rifle is a bolt action, it is desirable that the shield 10 be of a flexible material, such as flexible latex rubber, where by in drawing the bolt rearward, the shield 10 will flex and bend and permit the bolt to pass by flexing the end of the sunshade as necessary. In this manner, as large a shield as necessary or desired may be utilized, but still permitting the operation of the rifle. Generally, the shield 10 may be a somewhat modified semi-circle with a partial opening generally at its center to surround the circular end of the scope. For applications to other types of rifles such as a pump, automatic, or carbine utilizing a scope, a durable and hard shield may be employed as in those rifles the action will not interfere with the sunshade, nor the reloading mechanism in any way engage the sunshade.

In addition to the aforementioned latex rubber, hard rubber, plastics, or most any other type of material may be utilized. With regard to the light blocking qualities of shield 10, from an opaque material, different degrees of opacity may be utilized to a point where the material is translucent to the point of almost being transparent, employing all the shades of opacity that one might find in sunglasses, for example.

Still referring to FIG. 1, the scope 20 is shown attached to the receiver 24 of the rifle by scope mount 26. In the left hand end of scope 20 is the front eye piece 28 which allows entrance of light into scope 20 for viewing at the opposite sighting end through the scope rear eyepiece 22 to which is attached the invention. Receiver 24 is then connected to barrel 30 of the rifle and both receiver 24 and barrel 30 are set in the rifle stock 32.

Figure 2:
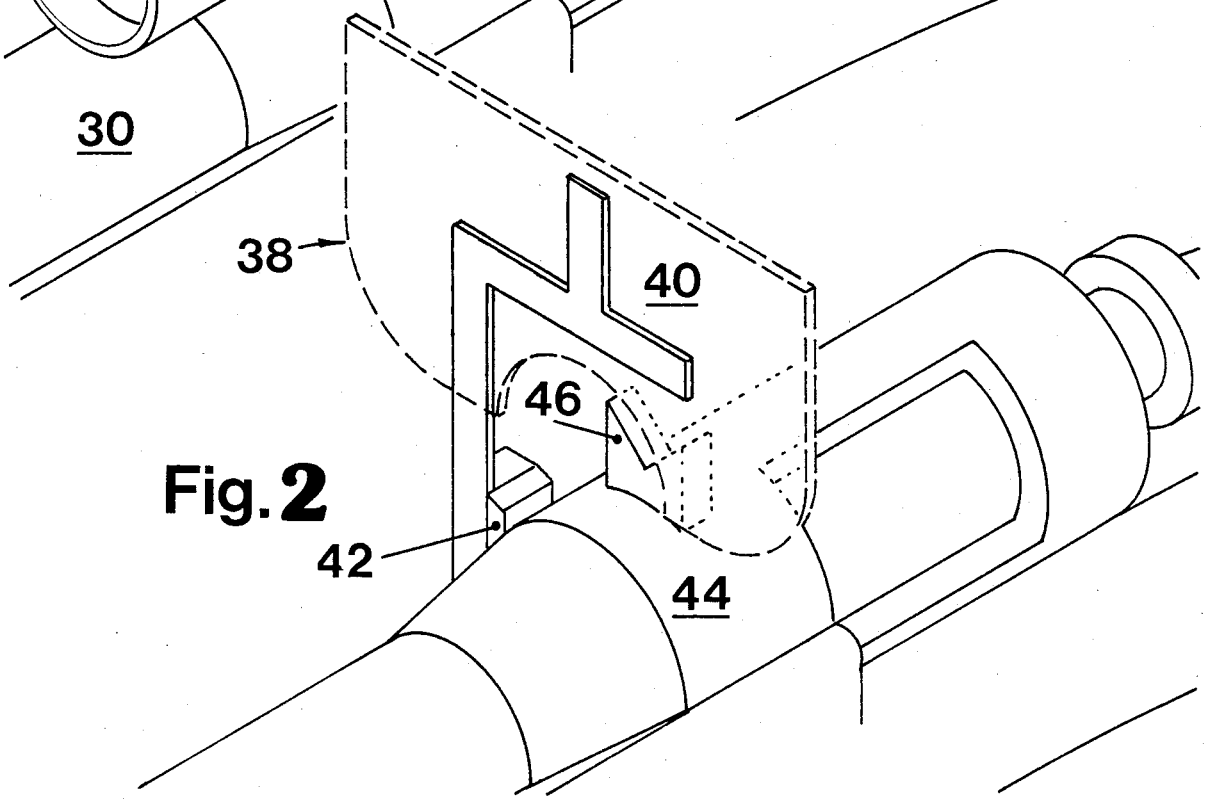
FIG. 2 is a fragmentary perspective view of the subject invention mounted upon a rifle with open sights.
Figure 4:
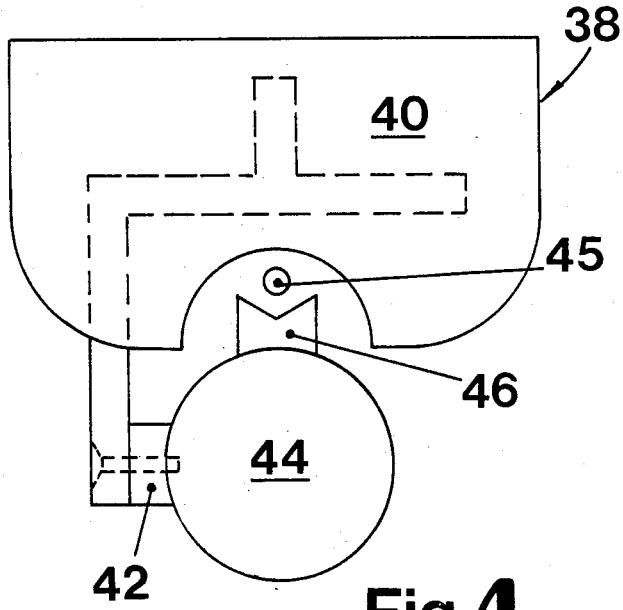
FIG. 4 is a shooter's view of the invention mounted upon a rifle with open sights.

Referring now to FIG. 2, a fragmentary perspective view of the subject invention mounted upon a rifle having iron or open sights is detailed. As can be seen, the thin, flat shield 40 performs the same function as did shield 10, only the means to mount the sunshade 38 is different. Here, since a scope is not available to receive the clamp, sunshade 38 is mounted to a structural member 42, which in turn mounts to the side of the rifle receiver 44. It is noted that the sunshade 38 is mounted forward of the rear open sight 46, and is such that the lower portion of the sunshade 40 is removed so that it does not obstruct the line of sight between the rear sight 46 and the front sight bead (not shown) at the forward end of the barrel. For ease of illustration and understanding, shield 40 has been shown in dotted form in order the portions of the rifle which identify it as one with open sights and which would normally be hidden from view are shown so that the positional relationship between sunshade 40 and the rifle may be more clearly seen and understood. Structural member 42 is normally attached to receiver 44 of the rifle by means of drilling and tapping a hole into receiver 44 and inserting a screw (FIG. 4) through structural member 42 into receiver 44. Of course, other attachment methods may be employed, such as utilizing an adhesive.

Again, all the atributes and features of sunshade 38 that were detailed above for sunshade 1 are applicable such as shape, material, opacity and the like; although, in the position where sunshade 38 is located on the rifle of FIG. 2, no interference with the bolt of the rifle is anticipated as the sunshade 38 resides forward of the rifle action. Obviously also, for both above applications, the shield need not be of absolutely flat construction, but may be curved, or even take a complex curve such as a portion of a sphere.

Referring now to FIGS. 3 through 7, various and different embodiments of the subject invention are illustrated showing the different configurations the sunshade may take, the different types of clamps or other securing means used to attach the shield to a rifle with or without a scope, and different types of rifles which may receive the subject invention.

Figure 3:
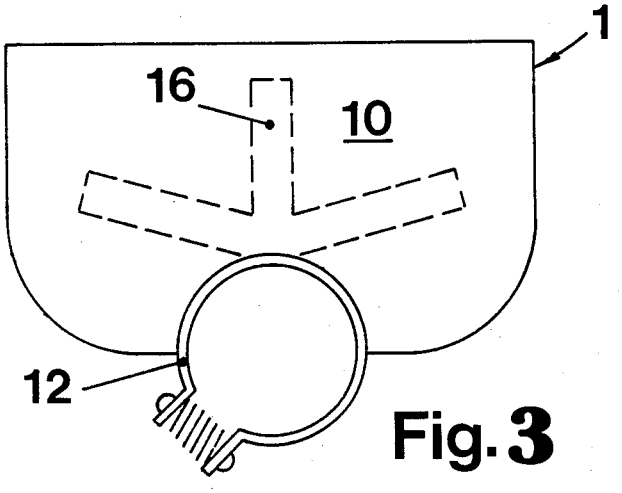
FIG. 3 is a view of the invention mounted on a scope as seen by the shooter's eye.

More specifically, FIG. 3 is a view of sunshade 1 as seen by the shooter as he might utilize the invention. Firstly, immediately outside the periphery of the scope rear eyepiece 22 is seen clamp 12 which encircles the eyepiece 22 and which is held firmly in place by means of a spring 14 which attaches to opposite ends of the clamp 12, holding it securely on the periphery of the scope rear eyepiece 22. Attached then to clamp 12 is shield 10 which, as shown by the dotted line in FIG. 3, has metal, such as steel or aluminum, structural supporting fingers 16 buried within the shield to provide support and to keep it always at a generally right angle with the longitudinal axis of scope 20. It is noted that the structural supporting fingers 16 are in the upper portion of shield 10 and the reason for this, in addition to the gravity effects, is that if the sunshade is to be used with a bolt action rifle, the shield may be made of a pliable material such as latex rubber wherein the lower lobes are flexible and will flex to allow the handle of the bolt to slide past by bending the material out of the way. As can be seen with the configuration shown in FIG. 3, sunshade 1 is easily removed from the scope rear eyepiece 22 by merely separating the ends of clamp 12 and sliding the clamp 12 rearward until it separates from the rear eyepiece 22. The structural supporting and reinforcing fingers 16 which are buried interiorly to shield 10 are, in the preferred embodiment, attached to clamp 12 by a piece of the fingers 16 stalk portion bent at a 90° angle to that part buried within shield 10. This piece of finger 16 may be attached to clamp 12 by welding or adhesive or other suitable method. The piece of finger 16 is shown at the very top-most portion of clamp 12. Clamp 12, in the preferred embodiment, is similarily made from metal, but then covered with plastic or rubber so as not to scratch the surface of the scope rear eyepiece 22 and to present a pleasing appearance. It is envisioned that clamp 12 may also be made from a plastic which has some qualities of flexibility, as well as may the structural supporting fingers 16. In fact, clamp 12 and structural supporting fingers 16 may constitute one single piece of material, be it a plastic, metal such as spring steel, or most any other structurally satisfactory material. It is obvious that the fingers 16 may be located on the exterior surface of shield 10 and attached with mechanical fasteners, such as rivets, or by an adhesive.

FIG. 4 is again the shooter's view of sunshade 38 mounted upon a rifle with open sights. In addition, here a differently shaped shield is suggested. Like shield 10, shield 40 has structural supporting fingers interiorly for the purposes of providing support, the supporting fingers emerging from shield 40 to continue into the structural member 42 which attaches to the receiver 44 of the rifle. As mentioned above, shield 40 must be so shaped on its underside so as not to block the view between the rear sight 46 and the bead of the front sight 45 which is shown within the trough of rear sight 46. It may be desirable to provide even additional viewing area immediately to the rear sight 46 by providing a half moon into the shield 40 immediately above rear sight 46. This would provide additional viewing area for the shooter around the target. Of course a balance must be struck between which area is to be shaded and which area is to be left open.

Figure 5:
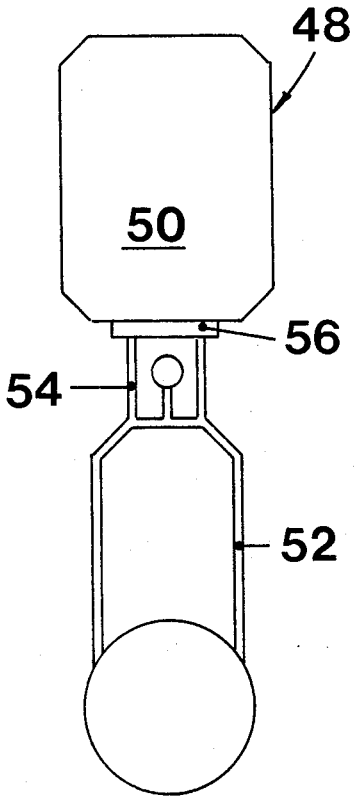
FIG. 5 is a shooter's view of the subject invention as applied to a military rifle.

FIG. 5 details the inventive sunshade 48 applied to a military rifle 52, and more specifically, the M-16 rifle. In the military rifle, the rifle is sighted through a box sight 54 which is on the upper portion of the rifle. Applicant's inventive sunshade 48 then would reside immediately above box sight 54, and for ease of use and/or removal, is designed to be attached with a hinge 56 whereby the shield 50, when not being used, may be pivoted at its hinge point to lay down flat upon the top of the rifle. In this way, shield 50 can very easily be flipped upward for use, folded over downward when not desired to be used, and always stays with the rifle, not subject then to be misplaced. In a case such as application to a military rifle, shield 50 is most preferably constructed of a thin sheet metal.

Figure 6:
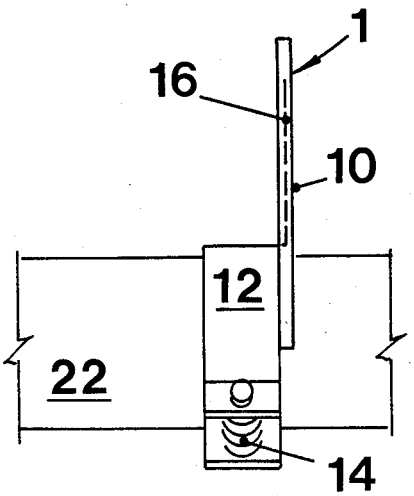
FIG. 6 is a side view of the invention mounted upon a telescopic sight.

Referring now to FIG. 6, a fragmentary side view of sunshade 1 shown in position on the end of the scope rear eyepiece 22. Here can be clearly seen the generally right angle relationship between the shield and the longitudinal axis of the scope. Also, the structural supporting finger 16 interiorly to shield 10 is shown with a dotted line, the structural supporting fingers 16 also being bent over for attachment to clamp 12. Spring 14, holding clamp 12 firmly around the scope rear eyepiece 22, is also detailed.

Figure 7:
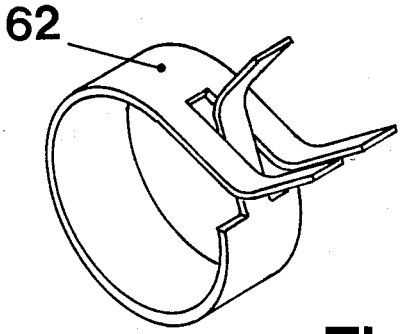
FIG. 7 is a perspective view of an alternate clamp for use in the invention.

An alternate embodiment of the clamp surrounding the scope rear eyepiece 22 is shown in FIG. 7 where a spring metal clamp that encompasses the total periphery of the scope's rear eyepiece is detailed. This clamp 62 is of the common variety readily available, it having on its broken ends, three fingers, two outside fingers at one end and a central finger on the other end of the clamp. These fingers are grasped by the operator, pressed together which enlarges the clamp, and then inserted on the scope rear eyepiece. The pressure on the ends is then released and the clamp secures itself around the scope rear eyepiece. To this clamp would be attached the shield 10, for example, by the same means and manner that the shield is attached to the clamp 12.

It is to be noted that in bolt action rifles, it is common for the bolt of the rifle, when it is in its rear drawn position, to pass very closely to the under side of scope rear eyepiece 22. Therefore, it is suggested that the clamps which surround the scope rear eyepiece 22, together with their covering, should be of a thin material, certainly not having a total thickness greater than 1/16th. inch. If metal is utilized in the clamp, such as spring steel, achieving a thickness of less than 1/16th inch with the covering would present no problems. If a plastic or other molded material were utilized as a clamp, care must be taken to make the thickness of the clamp such that it does not interfere with the action of the bolt.

Lately there has been a trend to apply telescopic sights to pistols and handguns. In such a case, it is obvious that Applicant's invention may very easily be used. Similarly, on a handgun with open sights, the invention may also be employed utilizing appropriate mounting apparatus attaching between the shield and the frame of the handgun.

In addition, it is apparent that Applicant's invention may be adopted to a large variety of optical instruments, in addition to telescopic sights for rifles, such as cameras and the like. For example, FIG. 8 illustrated a hand held camera employing Applicant's sunshade for protecting the photographer's eye while utilizing the camera. In this Figure, sunshade 68 is attached to the camera frame 72 by means of structural mechanism 74. The photographer's eyes are thus shaded when looking in the viewfinder 76 as the camera may be pointed in the vicinity of the sun.

While a preferred embodiment and alternate embodiment of the invention has ben shown and described, it will be apreciated that there is no intent to limit the invention by such disclosure as it is apparent that various other embodiments such as different designs and clamp closures may be utilized. Accordingly, the disclosure is intended to cover all modifications and alternate embodiments falling within the spirit and the scope of the invention as defined in the appended claims.

I claim:

1. A sunshade for attachment to a rifle with open sights to block interfering rays of light from a source of light from entering a shooter's aiming eye when aiming the rifle barrel in the vicinity of the source of light, the sunshade comprising:

a shield; and means attaching said shield to the rifle proximate the rifle rear sight and proximate the shooter's eye in order to shield the shooter's aiming eye from the offening light rays.

2. The sunshade of claim 1 wherein said shield is situated at right angles to the rifle barrel by a structrual member attaching said shield to said rifle.

3. The sunshade as defined in claim 2 further including reinforcement attached to said shield, said reinforcement also attached to said structural member.

4. The sunshade as defined in claim 2 wherein said means attaching said shield to the rifle defines a hinge whereby said shield may be folded down when not in use.

5. The sunshade as defined in claim 3 wherein said reinforcement operably attached to said shield includes reinforcement embedded interiorly to said shield.

6. The sunshade as defined in claim 3 wherein said shield comprises flexible material chosen from the group consisting of rubber, latex rubber, and plastic.

7. The sunshade as defined in claim 3 wherein said shield is opaque to light rays.

8. The sunshade as defined in claim 3 wherein said shield is translucent to light rays.

9. The sunshade as defined in claim 3 wherein said shield defines a thin, flat semi-circular shield.

10. A sunshade for attachment to a rifle having a telescopic sight with a rear eyepiece mounted thereon, the sunshade adapted to block interfering light rays from a source of light from entering the shooter's aiming eye other than through the telescopic sight when the shooter aims the rifle in the vicinity of the source of light, the sunshade comprising:

a shield; and means attaching said shield to the telescopic sight rear eyepiece in order to shield the shooter's aiming eye from offending light rays.

11. The sunshade of claim 10 wherein said shield is situated at right angles to the telescopic sight by a structural member attaching said shield to the telescopic sight rear eyepiece.

12. The sunshade as defined in claim 11 wherein said means attaching said shield to the rifle's telescopic sight includes a clamp, said clamp adapted to surround the telesopic sight rear eyepiece.

13. The sunshade as defined in claim 12 wherein said shield defines a thin, flat semi-circular shield.

14. The sunshade as defined in claim 12 wherein said clamp includes a coating of protective material, said protective material adapted to protect the telescopic sight rear eyepiece.

15. The sunshade as defined in claim 14 wherein said clamp comprises a broken annular ring with opposing ends, said ends connected by a spring whereby tension of the clamp on the telescopic sight rear eyepiece is applied by said spring pulling the two ends of said circular clamp together.

16. The sunshade as defined in claim 14 wherein said clamp defines an annular ring having two overlapping ends adapted to be grasped and pressed together to expand the circular diameter of the clamp for placement upon the telescopic sight rear eyepiece.

* * * * *